United States Patent [19]

D'Andrade et al.

[11] Patent Number: 4,508,516

[45] Date of Patent: Apr. 2, 1985

[54] STEERING SYSTEM AND REVERSIBLE DRIVE FOR TOY VEHICLES

[75] Inventors: Bruce M. D'Andrade, Whitehouse Station, N.J.; Johnny Y. Sing Chuen, Hong Kong, Hong Kong

[73] Assignee: Arco Industries Ltd., Hong Kong, Hong Kong

[21] Appl. No.: 519,819

[22] Filed: Aug. 3, 1983

[51] Int. Cl.[3] ..... A63H 29/00

[52] U.S. Cl. ..... 446/443; 446/454

[58] Field of Search ..... 446/437, 443, 454, 460, 446/462, 457, 456, 290, 279

[56] References Cited

U.S. PATENT DOCUMENTS

| | | | |
|---|---|---|---|
| 3,187,462 | 6/1965 | Licitis . | |
| 3,246,719 | 4/1966 | Lahr . | |
| 3,402,505 | 9/1968 | Nakamura | 446/454 |
| 3,564,765 | 2/1971 | Stormon et al. . | |
| 3,590,526 | 7/1971 | Deyerl . | |
| 3,849,931 | 11/1974 | Gulley, Jr. | 446/460 |
| 4,231,183 | 11/1980 | Lahr . | |
| 4,459,776 | 7/1984 | Jaworski et al. | 446/462 |

*Primary Examiner*—Mickey Yu
*Attorney, Agent, or Firm*—C. Hercus Just

[57] ABSTRACT

A remote control toy vehicle having a chassis with a pair of wheels respectively adjacent opposite ends thereof, a pair of electric motors of reversible polarity, drive mechanism respectively between said motors and the fore and aft wheels on opposite sides of the chassis, a battery, electric circuitry between the battery and said motors, separate switches in the circuitry of which one is operable to cause the motors to have the polarity reversed selectively to effect forward or rearward movement of the vehicle, and the other switch is operable to connect a resistance selectively into the circuitry of one or the other motors, whereby the motor having the resistance in the circuit runs slower than the other and the faster running other motor drives the wheels on one side of the vehicle faster than the wheels on the other side and thereby effects turning of the vehicle selectively in one direction or the opposite direction. The switches and battery are in a support remotely connected to the motors on the chassis by a flexible electric conduit of pre-determined length.

4 Claims, 14 Drawing Figures

STEERING SYSTEM AND REVERSIBLE DRIVE FOR TOY VEHICLES

BACKGROUND OF THE INVENTION

Powered toy vehicles is a subject which has interested inventors for an extensive period of time. Before the days of small electric motors, many toy vehicles were designed to utilize coiled spring motors and the like. Subsequently, electric motors of small size were developed and incorporated in bodies of the vehicles and arranged to drive at least certain wheels of the vehicles by means of electric energy supplied either from a remote source or, preferably, from batteries either within the vehicle or in a remote support. Accordingly, compared with steering the vehicle, powering the same for driving especially in a forward direction was not a very difficult problem.

One example of a toy vehicle powered by battery means carried by the chassis is the subject of prior U.S. Pat. No. 3,187,462 to Licitis, dated June 8, 1965, and in which a programmed control means was included to drive the car sequentially to move forward, stop, then rearwardly, and finally, to stop. The front wheels are steered by means of a cam operated by a separate electric motor, the cam being arranged to provide different paths, depending upon the shape of the cam. Still another toy vehicle having electric motor means to drive the rear wheels also includes control means for a pair of electric motors arranged to be individually driven at a selected speed or different speeds and, when driven at different speeds, being operable to turn the front wheels which are mounted in the same manner as modern automobiles employ, and the rear wheels being the only driving wheels. See Pat. No. 3,246,719, dated Feb. 23, 1971.

One other type of electrically powered toy comprises the subject matter of prior U.S. Pat. No. 3,564,765 to Stormon et al, dated Feb. 23, 1971, in which a pair of wheels adjacent one end of the body of the toy support it and another pair of wheels are mounted for rotation about a vertical axis and are driven to propel the vehicle, said latter pair of wheels being continually revolved about said axis in order to provide various paths of movement for the vehicle. A somewhat related powered toy vehicle also comprises the subject matter of prior U.S. Pat. No. 3,590,526, to Deyerl, patented July 6, 1971, and in which a pair of wheels adjacent one end of a chassis are independently driven by separate motors adapted to be operated at different speeds, as desired, and such difference in speeds being effective to cause steering wheels at the opposite end of the chassis, which are mounted similarly to the front wheels of modern automobiles, are caused to simultaneously pivot in a direction in which they are compelled to move by the different speeds of the driving wheels at the opposite end of the vehicle.

One other more modern U.S. Pat. No. 4,231,183, to Lahr, dated Nov. 4, 1980, shows a differential gear drive for a toy vehicle in which a single motor derives current from rails on a track as the vehicle moves along the track and transmission means vary the speed of the drive wheels differently by means of spur gears and driving gears of different numbers of teeth operable in conjunction with a reversible transmission frame.

It is one of the major objects of the present invention to provide a novel means for steering a toy vehicle and in which different principles are embodied from those in the aforementioned prior U.S. Patent, details of which are set forth below.

SUMMARY OF THE INVENTION

It is one of the objects of the invention to provide a toy vehicle having a chassis in which pairs of wheels respectively are supported adjacent opposite ends of the chassis, the chassis also supporting intermediately of the ends thereof a pair of small electric motors and drive shafts extend longitudinally along the chassis at opposite sides of the central axis of the chassis and respectively are driven by said electric motors in such manner that both the forward and rearward wheels are simultaneously driven in the same direction, selectively either forward or rearward, and the motors being adapted to be driven at different speeds when desired to effect turning of the chassis to one side or the other by means of driving both the fore and aft wheels at one side of the chassis by one motor operating at higher speed than the other motor which drives the fore and aft wheels at the opposite side of the chassis at a slower speed.

One of the features of the invention is to provide preferably remote control switches for said motors which are connected in a circuit extending between said switches and the motors on the chassis as well as to power means comprising one or more D.C. batteries, said switches being operable respectively and selectively to drive the motor simultaneously and unidirectionally to effect forward or rearward movement of the vehicle, while the other switch is operable to control the speeds of the motors and effect different speeds thereof when it is desired to turn the vehicle, the circuit for the switch which controls the turning of the vehicle including a resistance which is connected operatively into the circuit when it is desired to turn the vehicle and thereby cause the motor which has the resistance in its circuit to move more slowly than the opposite motor, whereby the latter faster motor drives the fore and aft wheels at one side of the vehicle faster than the wheels at the opposite side thereof but while the wheels on the opposite side nevertheless are still rotated to cause the vehicle to move forward or rearward and in a curved path until the switch is reversed, for example, or rendered neutral, respectively to cause the vehicle to move in an opposite curve direction or be stopped.

In regard to the foregoing feature, it is a further characteristic that the switch means which respectively control the forward or rearward direction of the vehicle and the speed of the motors to effect turning of the vehicle or moving the frame along a curved path include pivoted operating members having arms thereon respectively engageable with flexible, spring type movable contacts selectively disposable between a pair of fixed contacts in the switch members, only one of said movable contacts in said switches being moved at a time from contacting one of the fixed contacts to engaging the other in a manner to change the polarity of the electric motors to effect forward or rearward movement of the vehicle, and the switch means which controls the speed of the motors also having a pair of arms selectively engageable with a pair of resilient movable contact members which normally are in engagement with a fixed contact in the switch and operable to move one or the other of said movable contacts from engagement with a fixed contact in order to dispose resistance means in the circuit between the battery and the motor which is to run slower than the other and thereby cause the fore and aft wheels on one side of the chassis to move slower than those on the other side.

Still another feature of the invention is to mount the control switches and the batteries preferably in a housing remote from the vehicle and connected to the motors in the vehicle by flexible conduit means of predetermined length, thus providing remote control for the vehicle both in regard to steering and the direction of movement of the vehicle, said housing also having a pair of openings therein through which the switch actuating members of said control switches project for swinging movement about fixed pivots and thereby effect movement of the arms on said actuating members for the purposes described above.

Detailed description of the foregoing objects and of the invention, as well as other objects thereof, are set forth in the following specification and illustrated in the accompanying drawings comprising a part thereof.

DETAILED DESCRIPTION OF THE PREFERRED EMBODIMENT OF THE INVENTION

Figure 1:
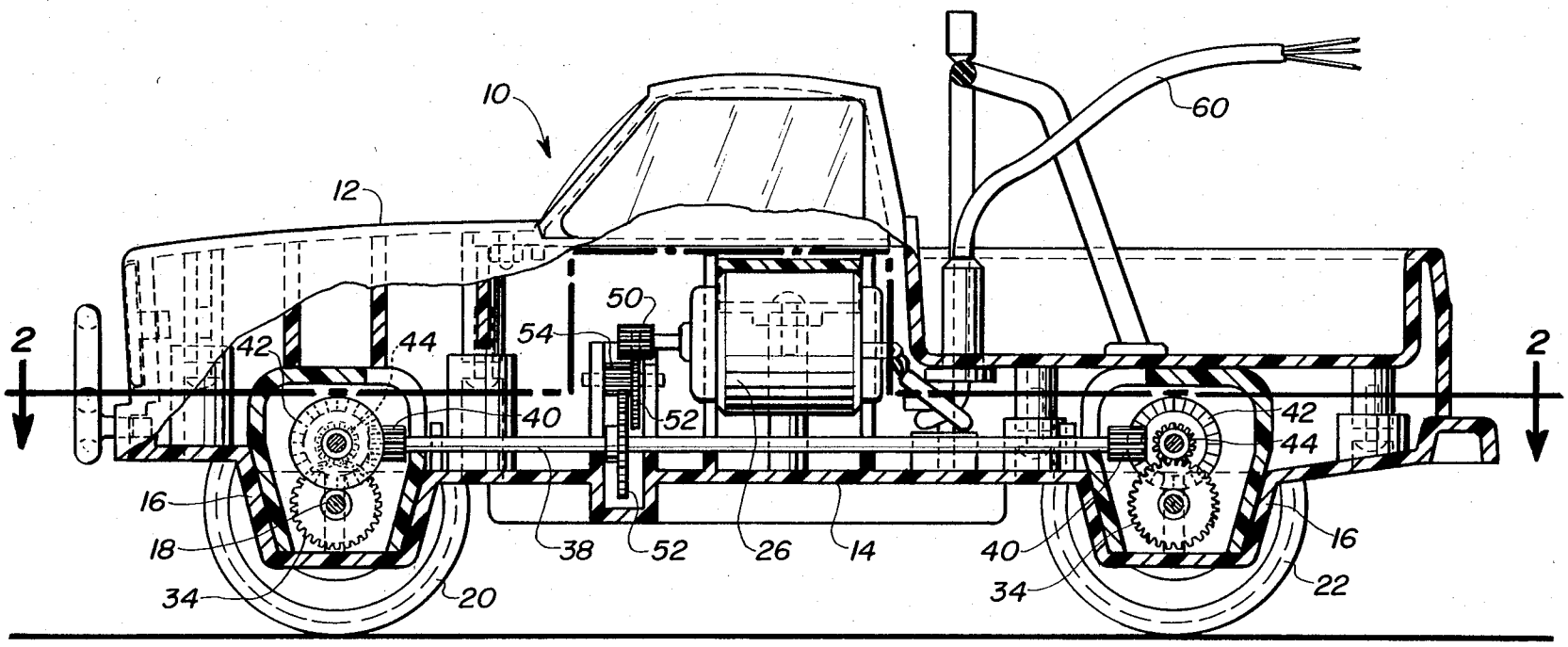
FIG. 1 is a side elevation, partly in section, of an exemplary toy vehicle embodying the principles of the invention and showing a fragmentary portion of a flexible electric conduit extending from the motor in the vehicle.
Figure 2:
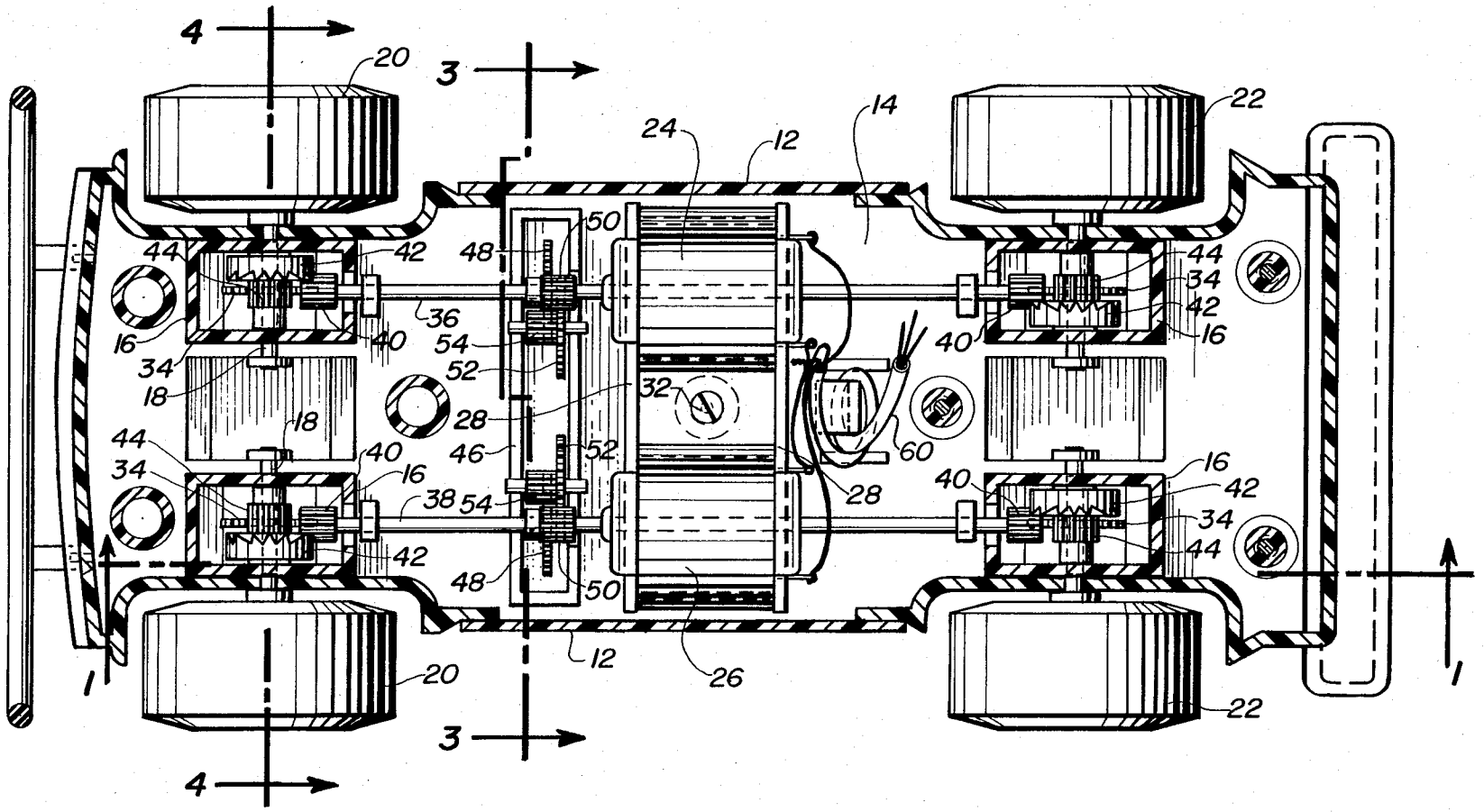
FIG. 2 is a horizontal sectional view taken on the line 2—2 of FIG. 1.

Referring to FIGS. 1 and 2, it will be seen that the exemplary toy vehicle 10 has a molded body 12 operatively connected to a lower chassis 14 having depressions 16 respectively adjacent opposite ends thereof for purposes of containing drive means described in detail hereinbelow. The body 12 and chassis 14 may be made from any suitable material but preferably are adapted to be molded from plastic material for precise shape and ease of assembly.

Referring to FIG. 2, in which the chassis is shown in plan view with the body 12 removed, it will be seen that relatively short axles 18 are rotatably supported in suitable bearings within the depressions 16 for purposes of independently supporting at opposite sides of the chassis a pair of similar front wheels 20, while adjacent the rearward end of the chassis 14, a pair of similar rear wheels 22 are independently mounted. Intermediately of the opposite ends of the chassis 14, a pair of small electric motors 24 and 26 are supported within grooved support means extending upward from the chassis 14 and a clamp member 30 is connected by securing means such as a screw 32 to the support means 28 for purposes of overlying the motors 24 and 26 and thus mounting them fixedly relative to the chassis 14.

Figure 4:
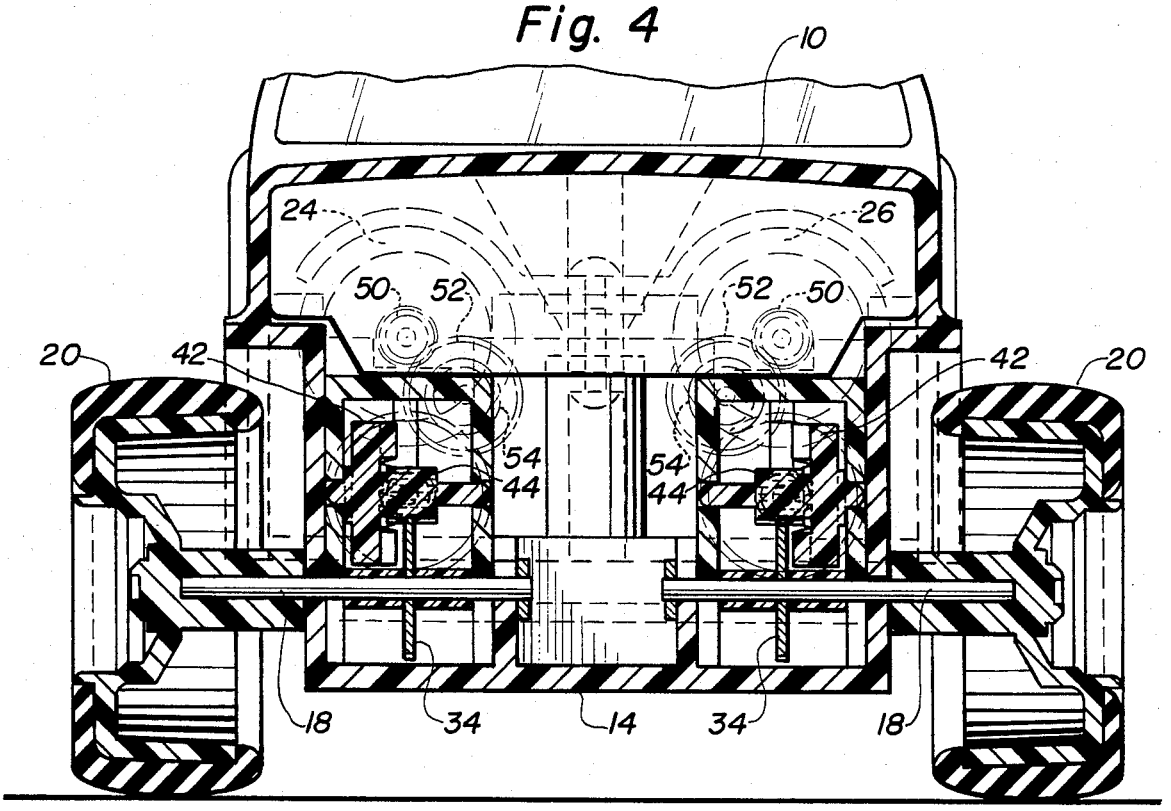
FIG. 4 is a vertical sectional view, partly fragmentary, showing the drive means for the forward wheels of the vehicle as seen on the line 4—4 of FIG. 2.

The mounting of the axles 18 for the forward wheels 20 is best shown in FIG. 4 and each axle 18 has a toothed gear 34 fixed thereto.

Figure 3:
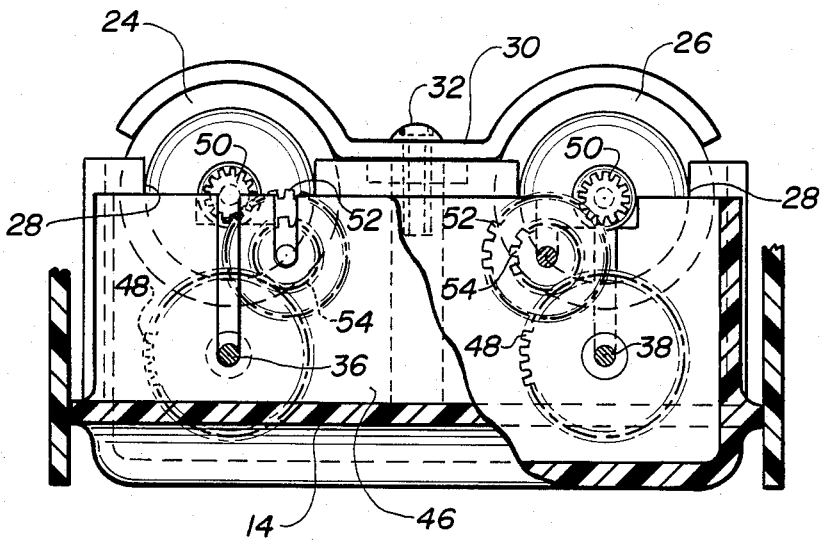
FIG. 3 is a vertical sectional view showing the motors and drive mechanism actuated thereby as seen on the line 3—3 of FIG. 2.

Unitary elongated axles 36 and 38 extend within support slots formed in the support means 28 which are vertical walls as best seen in FIGS. 2 and 3. Said axles extend between the forward and rearward wheels respectively on opposite sides of the median longitudinal axis of the chassis 14 and opposite ends thereof respectively extend into the depressions 16 which actually comprise small housings within which interengaged gearing is supported to effect driving of the fore and aft wheels respectively adjacent opposite sides of the chassis. Said gearing include pinions 40 fixed respectively to opposite ends of the shafts 36 and 38 and engageable with crown gears 42 which are fixed to additional pinion gears 44 that mesh with the toothed gears 34 for purposes of driving all of the wheels connected to each shaft 36 and 38 unidirectionally, either forwardly or rearwardly, as described in detail hereinafter.

The chassis 14 also has a transmission housing 46, best shown in FIG. 2, and in which a large diameter toothed gear 48 is disposed, one of said gears being connected respectively to each of the unitary drive shafts 36 and 38. The motors 24 and 26 each have a drive shaft to which pinion gears 50 respectively are mounted for meshing with intermediate gears 52 of a gear-reduction unit which also includes another pinion gear 54 that engages the toothed gears 48 to which the drive shafts 36 and 38 respectively are connected, whereby it will be seen that the motors 24 and 26 respectively drive the unitary drive shafts 36 and 38 for purposes of driving simultaneously the fore and aft wheels 20 and 22 respectively adjacent opposite sides of the chassis 14.

POWER AND CONTROL UNIT

Figure 5:
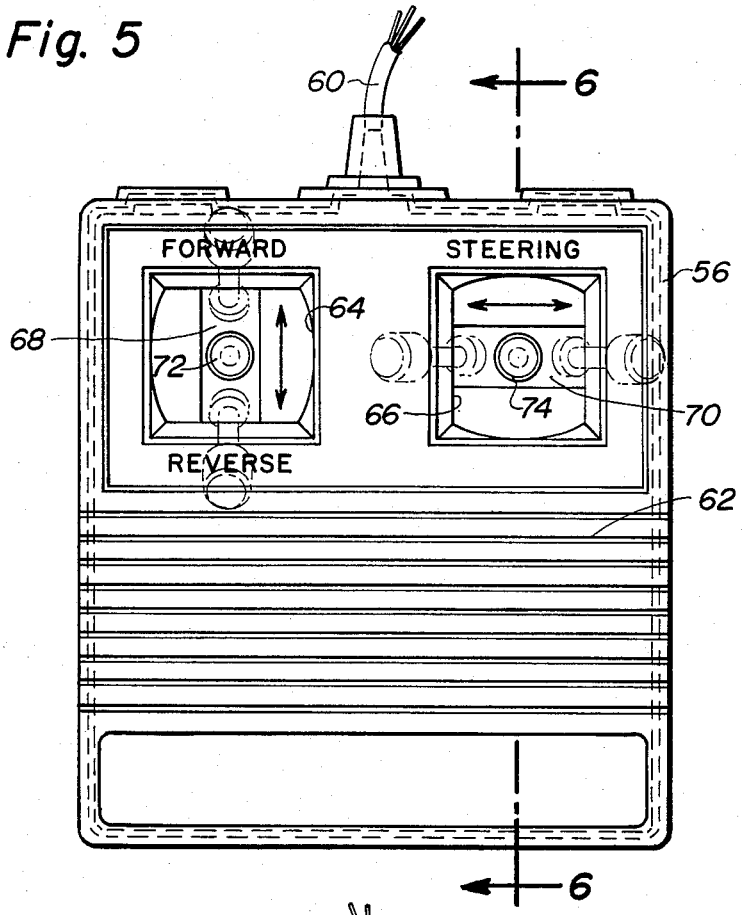
FIG. 5 is a face view of an exemplary control housing which supports the switches for the electric circuit for the steering and drive systems of the vehicle.
Figure 6:
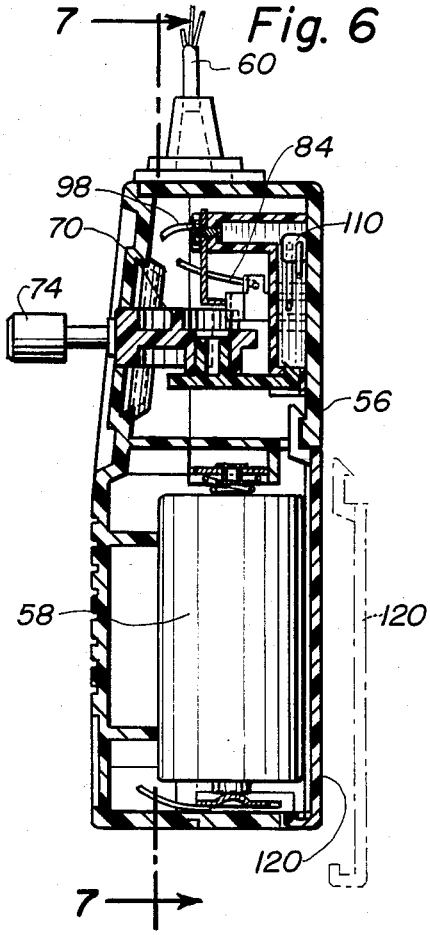
FIG. 6 is a vertical sectional view to the housing shown in FIG. 5 as seen on the line 6—6 thereof.
Figure 7:
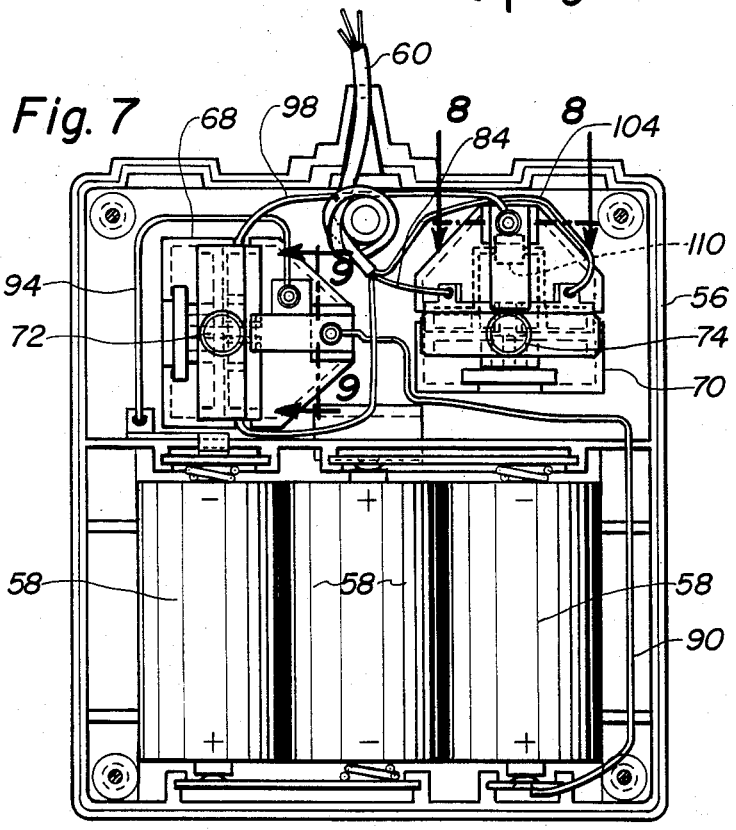
FIG. 7 is a vertical sectional view of the control housing shown in FIG. 6 as seen on the line 7—7 thereof.
Figure 8:
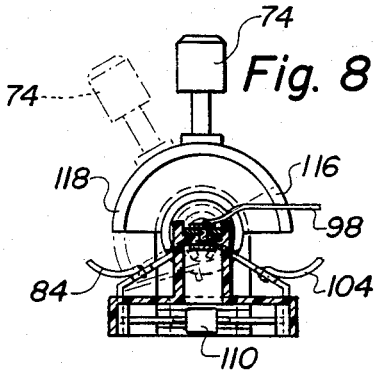
FIG. 8 is a fragmentary sectional view of a detail of the switch actuating member of one of the switches contained in the control housing of FIGS. 5–7, as seen on the line 8—8 of FIG. 7, the actuating member of the switch being shown in one position in full lines and in an alternate position in phantom.
Figure 9:
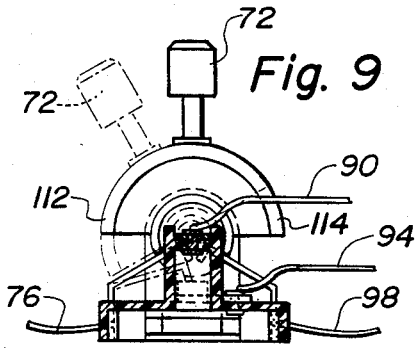
FIG. 9 is a view similar to FIG. 8 but showing a different switch from that shown in FIG. 8, as seen on the line 9—9 of FIG. 7 and illustrating in full lines one position of the switch actuating member, while the latter is shown in phantom in a second position.

Referring to FIGS. 5–7, there is illustrated therein a preferably portable housing 56 within which control switches, electric circuitry, and power means in the form of a plurality of electric batteries 58 of suitable voltage are mounted compactly in order that the driving and steering of the vehicle 10 may occur from a remote location, the control unit comprising the housing 56 and its contents being connected to the motors 24 and 26 by a flexible conduit 60 of pre-determined length. The housing 56 has a front face 62 in which a pair of openings 64 and 66 are located respectively to accommodate the direction switch unit 68 and the speed control or steering switch 70. As shown in FIG. 5, appropriate legends are provided on the front face 62 especially to indicate the direction of movement of the switch levers 72 and 74 respectively connected to the direction control switch and the speed control switch. For purposes of facilitating the normal inclination for moving the switch controls 72 and 74, it will be seen from FIG. 5 that control member 72 for the direction control switch 68 moves in a vertical plane as viewed in said figure, while the switch lever 74 for the speed control switch 70 moves in a horizontal plane as viewed in said figure.

Figures 10, 11, 12, 13, 14:
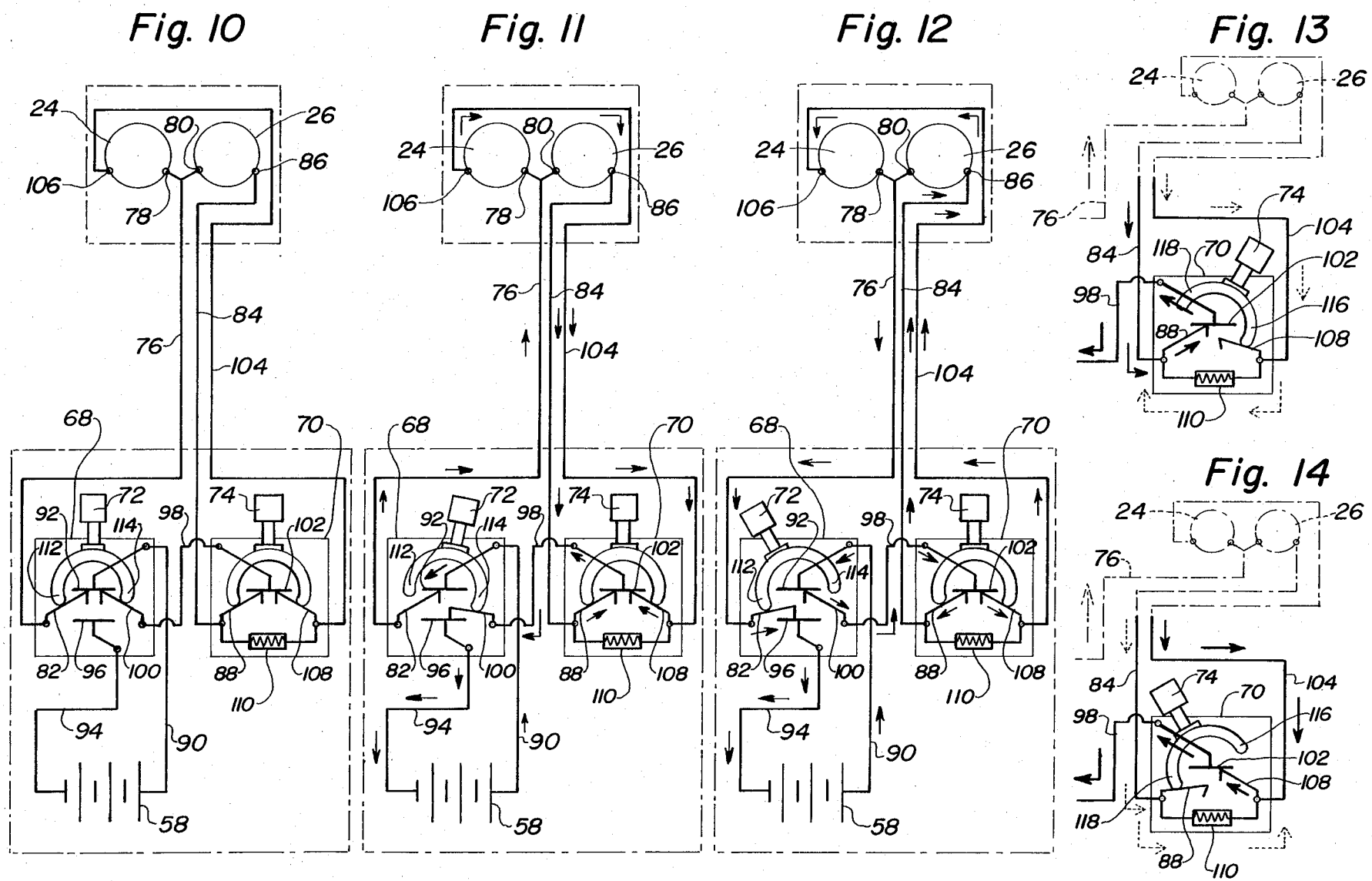
FIG. 10 is a schematic diagram of the control system for the vehicle and shows the controls in the stopped mode.
FIG. 11 is a view similar to FIG. 10 but is a schematic diagram illustrating the controls in the forward mode.
FIG. 12 is similar to FIGS. 10 and 11 but is a schematic diagram showing the controls in the reverse mode.
FIG. 13 is a schematic diagram of the right-hand portions of the control means shown in FIGS. 10–12 and in which the steering control switch is illustrated in a manner to effect turning of the vehicle in one curved path and FIG. 14 is a view similar to FIG. 13 but showing the control switch disposed in a manner to effect movement of the vehicle in the opposite curved direction from that effected by the position of the switch shown in FIG. 13.

Referring to FIGS. 10–12, in which the circuitry between the motors, control switch units and the batteries are illustrated with respect to various modes for the stopped, forward, and reverse directions for which the vehicle is to be subject for operation thereof. In FIG. 10, it will be seen that the electric motors 24 and 26 are connected by circuitry to the switches 68 and 70 and in which said switches are disposed in a stop mode and no movement of the vehicle will occur unless moved manually. For purposes of the invention, the electric motors 24 and 26 are of the reversible type by having reversible polarity. In the circuitry shown in FIG. 10, it will be seen that the same includes a first conduit 76 which is connected commonly to one pole 78 of motor 24 and one pole 80 of motor 26, the conduit 76 then extending to a first movable contact 82 of switch 68. The second conduit 84 extends from the other pole 86 of motor 26 and from there it is connected to a first movable switch member 88 of speed control switch 70. A third conduit 90 extends from one pole of battery 58 to an upper fixed contact 92 of direction switch 68. A fourth conduit 94 extends between the opposite pole of battery 58 and a lower fixed contact 96 of direction control switch 68. A fifth conduit 98 extends between a second movable contact 100 of direction control switch 68 and a fixed contact 102 of speed control switch 70. A neutral conduit 104 extends between the other pole 106 of motor 24 and a second movable contact 108 of speed control switch 70 and between first movable contact 88 and second movable contact 108 of switch 70 there is connected a resistance element 110 of suitable rating that when current directed to one of said motors includes said resistance element, that motor will run more slowly than the other motor in whose circuit the resistance element is not included and the difference in speed between said motors effects the turning of the vehicle in curved paths, either to the right or left hand, as desired, as controlled by the switch 70, details of which operation are set forth more extensively hereinbelow.

In the mode illustrated in FIG. 10, it will be seen that there is no circuit completed to the battery 58, whereby neither motor 24 or 26 is energized and the vehicle is stopped. When, however, it is desired to move the vehicle forwardly, the switch lever 72 of the direction control switch 68 is moved to position shown in FIG. 11 which is the forward mode of the control means and in which it will be seen that the switch lever 72 has a pair of arms 112 and 114 and the arm 114 engages the second movable contact 100 of switch 68 and moves it into engagement with the lower fixed contact 96 of switch 68 and thereby connects the battery 58 in the circuit of the motors 24 and 26 to cause current to flow up the first conduit 76 to the poles 78 and 80 of the motors 24 and 26 and thereby rotate said motors reversely to each other but in view of the fact that the drive pinions 40 engage crown gears 42 respectively on the forward wheels 20 which face each other the drive pinions 40 on the opposite ends of the drive shafts 36 and 38 engage crown gears 42 which extend oppositely from each other, all of the forward and rearward wheels 20 and 22 will be driven in a direction to cause the vehicle to move forwardly. Meanwhile, it is presumed that it is not desired to move the vehicle in a curved path, whereby the switch 70 in the modes shown in FIGS. 10 and 11 has not been activated. However, if desired, the vehicle may be moved in curved paths, either to right or left, by actuation of the switch 70 simultaneously with actuation of the switch 68 and such steering of the vehicle is described hereinafter.

When it is desired to move the vehicle rearwardly, the mode illustrated in FIG. 12 is resorted to and in which it will be seen that the switch lever 72 of direction switch 68 has been moved in the opposite direction to that shown in FIG. 11, whereby the arm 112 engages the first movable contact 82 of the switch and moves it into engagement with the lower fixed contact 96, whereupon the current is caused to flow up the conduits 76 and 84 to the poles 86 and 106 respectively of the motors 26 and 24, thereby changing the polarity from that shown in FIG. 11 and causing the motors respectively to run in opposite rotary directions from those imposed upon the motors by the mode shown in FIG. 11, whereupon the vehicle will be moved rearwardly until the switch actuator 72 is moved to the neutral position shown in FIG. 10.

Attention now is directed to FIGS. 13 and 14 which respectively relate to the right-hand sides of the modes illustrated in FIGS. 10, 11 and 12 and thereby pertain to switch 70 by which the speed of the motors 24 and 26 respectively is relatively changed in order that one motor will run slower than the other to effect movement of the vehicle in a curved path. Referring to FIG. 13, it will be seen that the switch lever 74 of speed control switch 70 has been moved clockwise from the position thereof shown in FIGS. 10–12, thereby causing arm 116 of switch lever 74 to engage second movable contact 108 of the switch and disengage it from the fixed contact 102, thereby causing current to flow down neutral conduit 104 and through the resistance element 110, thereby decreasing the current to motor 24 which becomes the slow motor, while the motor 26 operates at its normal speed due to the resistance element 110 not being included in the circuit to motor 26, thereby causing the wheels at the right-hand side of the chassis as viewed in FIG. 2, in which said wheels are uppermost, to move at a slower speed than the wheels 20 and 22 at the opposite side of the chassis, whereby the vehicle will move in a right-hand curve as viewed in FIG. 2.

Referring to FIG. 14, wherein the switch lever 74 has been moved to the opposite side from that shown in FIG. 13, the arm 118 thereon engages the movable contact 88 to separate it from the fixed contact 102 and thereby including the resistance element 110 in the circuit to motor 26 which then becomes the relatively slow motor, while motor 24 operates at its normal speed which is faster than that of motor 26 under the circumstances, thereby causing the vehicle to move in a left-hand curved path as viewed in FIG. 2 in plan view.

In the switches 68 and 70, the movable contacts 82 and 100 in switch 68 and 88 and 108 in switch 70 are illustrated as being flexible metallic members capable of being moved from engagement with the fixed contacts 92 and 102 and in regard to switch 68, the movable contact 82 is moved into engagement with the lower fixed contact 96 in the reverse mode as shown in FIG. 12. Following such movement and upon being disengaged by the arms of the switch levers, said movable contacts are readily capable of self-restoration to the normal position thereof illustrated in the various figures.

For purposes of installing and removing the batteries 58 within the lower part of the housing 56, it will be seen from FIG. 6 that the lower back portion of the housing comprises a cover 120 which is shown in full lines and cross-sectioned in FIG. 6 as being in the closed position, while in phantom, the cover 120 is shown removed. In view of the fact that the walls of the housing 56 preferably are formed from insulating material such as stiff plastic of suitable composition, cover 120 is also formed of similar material and is capable of having the lower end thereof snapped into locked position when being installed over the opening of the housing that is normally covered by the cover 120.

In FIGS. 6 and 7, insofar as possible, the various conduits have been identified by corresponding numerals to those used in the diagrammatic illustrations in FIGS. 10–14.

From the foregoing, it will be seen that the present invention affords a preferably small portable switch control unit in which batteries of desired voltage are contained as well and said control unit is connected by a flexible conduit of multiple wires and of pre-determined length, the opposite end being connected to the body of the vehicle as shown in FIG. 1. By simple movement of the switch levers 72 and 74, the vehicle may be made to move forward or rearward by actuation of the lever 74, or the same may be disposed in neutral position in which the vehicle is stopped. Similarly, by operating the switch lever 74 the speed control switch 70 selectively in opposite directions, the movement of the vehicle in either right-hand or left-hand curved paths can be achieved while all four wheels of the vehicle are being rotated unidirectionally but the wheels on one side of the vehicle are positively driven at a faster speed than those on the opposite side, thereby effecting the curved paths of the vehicle.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A toy vehicle having a chassis supporting a pair of wheels respectively adjacent opposite ends, a pair of electric motors of reversible polarity supported by said chassis, drive means connected respectively between said motors and each wheel of at least one of said pairs of wheels, a portable battery source of electric energy, electric circuit means connecting said source of energy respectively to each of said motors, a first multi-pole direction control switch means in said circuit means having a switch lever movable in opposite directions and operable selectively to deliver electric current to said motors for forward or reverse driving of said vehicle, electric resistance means in said circuit connectable by a second multi-pole speed control switch means having a switch lever movable in opposite directions and selectively operable in said circuit to connect said resistance means in the circuit to one or the other of said motors to drive at least one wheel of said one of said pairs of motors slower than the other and thereby cause said vehicle to turn in one direction or the opposite direction depending upon the reversible setting of said speed control, and said source of electric energy and said first and second switch means being remote from said vehicle and connected thereto by a flexible circuit conduit, said circuit and switch means being further characterized by comprising a first circuit conduit extending commonly from one pole of each motor to a movable contact of said direction control switch, a neutral conduit between the other pole of a first motor and a first movable contact of the speed control switch; a second conduit extending between the other pole of the second motor and a second movable contact of the speed control switch, a third conduit between one pole of said battery and a first fixed contact of said direction control switch, a fourth conduit between a second fixed contact of said direction control switch and the other pole of said battery, and a fifth conduit between a second movable contact of said direction control switch and a fixed contact of said speed control switch, whereby when the motors are in the stop mode, said first and second movable contacts of said direction control switch are in contact with said first fixed contact thereof and the first and second movable contacts of said speed control switch are in contact with the fixed contact of said speed control switch and said electric resistance means being connected between said neutral and second conduits where they are connected to said first and second movable contacts of said speed control switch.

2. The vehicle according to claim 1 in which when the vehicle is to go forward the switch lever of said direction control switch when moved in one direction has an arm engageable with the second movable contact of said direction control switch and moves it from engagement with said first fixed contact into engagement with said second fixed contact of said direction control switch and thereby energizes the polarity of both motors to rotate in a common rotary direction by which the vehicle is moved forward, and said switch lever when moved in the opposite direction has another arm operable to reversely shift the first and second movable contacts relative to the first and second fixed contacts and thereby reverse the polarity of the motors and thereby cause the vehicle to be driven in reverse direction.

3. The vehicle according to claim 1 in which when it is desired to cause the vehicle to turn in a righthand or lefthand direction by including said resistance in the circuit between the battery and one or the other of said motors to cause one motor to run slower than the other, said switch lever of said speed control switch has a pair of arms respectively adapted to engage said first and second movable contacts of said speed control switch, whereby when said lever is moved in one direction one of said arms engages said second movable contact of said speed control switch and disengages it from said fixed contact of said switch and thereby directs current from one pole of the motor which is to run slower and direct it through the resistor while the first movable contact remains in contact with said fixed contact so as to direct current to the other motor which is to run fastest without having to pass through said resistor, whereby the wheels on one side of said chassis are driven faster than the wheels on the other side of the chassis and thereby effect turning of the vehicle by the faster moving motor.

4. The vehicle according to claim 3 further characterized by the opposite arm on said lever when moved into engagement with said first movable contact of said speed control switch being operable to disengage said contact from the stationary contact and thereby cause current to pass through said resistor to the other motor which now is to run slower while said second movable contact engages said fixed contact and directs current to the motor which is to run faster without passing through said resistance, whereby said vehicle turns in the opposite direction due to the faster running wheels on the opposite side of said vehicle.

* * * * *